United States Patent [19]

Bradley

[11] 4,347,771

[45] Sep. 7, 1982

[54] APPARATUS FOR SHARPENING A DISC

[75] Inventor: John J. Bradley, Green Bay, Wis.

[73] Assignee: Paper Converting Machine Company, Green Bay, Wis.

[21] Appl. No.: 205,716

[22] Filed: Nov. 10, 1980

[51] Int. Cl.[3] ..... B26D 7/12

[52] U.S. Cl. ..... 83/174

[58] Field of Search ..... 51/248, 247, 246; 83/174.1, 174

[56] References Cited

U.S. PATENT DOCUMENTS 3,213,731 10/1965 Renard ..... 83/174

3,292,470 12/1966 Mystrand et al. ..... 83/174

4,041,813 8/1977 Spencer ..... 83/174

4,173,846 11/1979 Steiner ..... 51/248

*Primary Examiner*—Roscoe V. Parker

*Attorney, Agent, or Firm*—Tilton, Fallon, Lungmus & Chestnut

[57] ABSTRACT

A lightweight spring-loaded grinding wheel assembly for mounting adjacent a disc and wherein idling grinders are positioned away from a blade during inactive portions of the cycle, and upon release of an external force, the grinders are urged into co-acting and sharpening relationship with a blade by a flexing support.

10 Claims, 12 Drawing Figures

APPARATUS FOR SHARPENING A DISC

BACKGROUND OF THE INVENTION

This invention deals with an improved sharpening device and is defined in the environment of cutting convolutely wound logs of tissue or toweling product, and more particularly, its advantageous use on a log saw according to U.S. Pat. No. 4,041,813. While described in this environment, it will be recognized that the same principle of flexure spring-steel mounting and adjustable pre-set pressure with pneumatic unloading can be applied in numerous devices that require very light pressure engagement of the grinding stones to a blade being sharpened on an intermittent sharpening basis.

Cutting of logs made from tissue and toweling paper webs has been known for many years and proceeded from reciprocating to orbital type log saws as defined, for example, in U.S. Pat. Nos. 3,213,731 and 3,292,470. In these earlier log saws, the grinding stones were mounted on a driven rotating shaft which was moved in an axial direction to force the grinding stone against the blade during a sharpening cycle. Actual movement of the shaft was usually activated by pneumatics. However, the static or "break away" friction was often high enough that once activated, the resultant force of the stone against the blade resulted in heavy grind pressures and premature wear of both the grinding stone and blades. Given the presence of oil spray mist, paper dust, and abrasive stone dust, each of the pneumatic cylinders actuating discrete grinding stones operated differently with the result that unequal pressures could be applied to each side of the blade resulting in unequal taper. Driven grinding stones mounted on pneumatically operated slidable shafts represented the state of the art for many years.

In recent years, and as production output from log winders increased, a newer type of orbiting saw having two blades mounted on a common orbiting arm and as described in U.S. Pat. No. 4,041,813 entered the commercial market. Further, the advent of grinding stones having a thin layer of cubic boron nitride resin bonded to the underlying grinding wheel made it possible to eliminate the driving means because this abrasive facing material was very hard and durable and hence was not prone to spot wear during the first few moments of grind when it is essentially non-rotating—see U.S. Pat No. 4,173,846. Free to rotate, the non-driven grinding wheel soon begins to spin, resulting in wear that is uniformally and evenly distributed over the entire annular surface of the grinding face. On earlier models of log saws according to U.S. Pat. No. 4,041,813, the driving means was eliminated, but the idling shaft and grinding stone were still urged against the blade by pneumatic force, and hence unequal grind pressures on each of the stones and heavier than desired grinding pressures were involved. For initial setup, the grinding face was brought into contact with the blade and then adjusted against the blade until it deflected approximately 0.005". This resulted in a moderately heavy grind pressure at the start and established a very limited range of movement (and pressure). With the heavy pressures, the blade wore away quickly and the 0.005" deflection quickly diminished to the point where a new adjustment and positioning was required. In other words, frequent adjustment of the stone grinding positions was involved. When sawing logs comprising thin cores and soft tissue grades rather infrequent sharpening is required, but on tissue grades that are wound more firmly and/or having thicker cores with clay coatings, etc., the sharpened blades became dull faster and hence, the sharpening cycle time decreased. When originally set up to deflect the blade 0.005", and adjustable stop or "limit of travel" insured that greater deflections and heavier pressures would be avoided. When denser or harder to cut stock was involved, operators frequently adjusted the grinding wheel to deflect the blade greater than 0.005" in order to extend the interval of time between adjustments, and with higher than recommended grinding pressures, scalloping of circular blades became a problem. Scalloping refers to the tendency for the circular blade to have "segmented flats or chords" at the periphery and hence, it is no longer perfectly circular. This effect not only decreased the quality of the cuts, but drastically reduced the life of the cutting blade as well as the abrasive facing on the grinding wheel used to sharpen it.

In essence, the original sharpening device used on saws according to U.S. Pat. No. 4,041,813 was "positioned" as opposed to "pressure regulated" and because of the frequency required for adjustment of the grinding assembly and other limitations, a new grinding means was required.

One of the primary objectives of this invention is to overcome the resultant heavier grind pressures generated by the pneumatic pressure required to overcome static friction. Another important aspect of this invention was to have a substantially frictionless device so that very light grind pressures could be applied equally on each of the grinding stones to maintain the same bevel on each side of the blade. The inventive grinding device overcomes several of the above-mentioned problems by allowing very light grinding pressures without significant blade deflection, provides uniformly light pressure over a much wider range of grinder actuation and adjustment, and hence, requires much less frequency of adjustment and less down time of the log saw and upstream rewinding equipment. Benefically, the lighter pressure results in elimination of scalloping while providing longer blade life, and longer life of the boron nitride facing on the grinding wheels. In addition to these benefits, uniformly high quality cuts are produced. Other objectives will become evident in the detailed description of the invention.

DETAILED DESCRIPTION

The invention is described in conjunction with an illustrative embodiment in the accompanying drawing, in which FIG. 1 is an elevational view, generally schematic, of log sawing apparatus which constitutes an advantageous environment for the invention;

Figure 1:
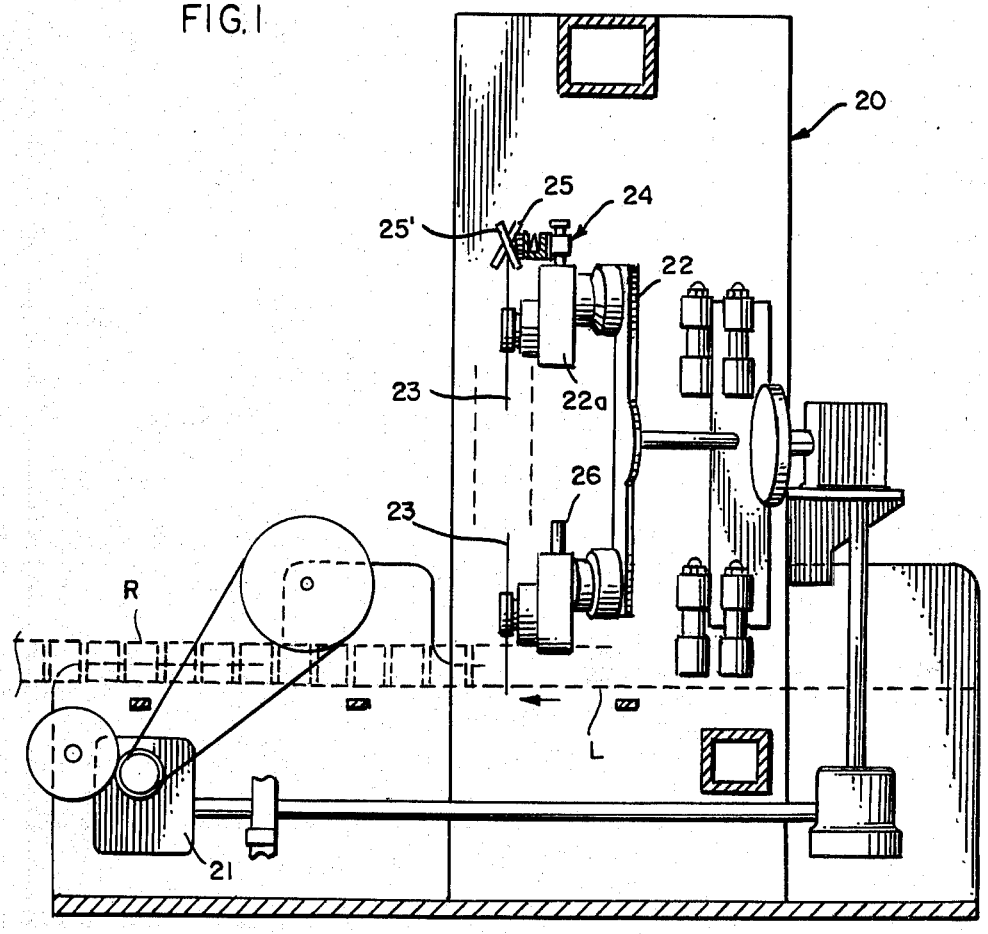

In the illustration given, and with reference first to FIG. 1, apparatus for transversely cutting wound paper logs is illustrated as being an especially advantageous use of the inventive sharpening means. In FIG. 1, the numeral 20 designates generally the frame of the log saw which is seen to provide a mounting for a motor and gear box 21 providing power to advance a log L along a lineal path and for rotating an arm 22 so as to orbit disc blades 23. Power from the unit 21 also rotates the disc blades 23 so as to cut the log L into a number of discrete rolls R while the log is being continually advanced. In accordance with the teachings of U.S. Pat. No. 4,041,813, the arm 22 is skewed relative to the perpendicular to the path of travel of the log L so that the saw operates in a continuous motion, i.e., advances with the log so as to provide a continuous operation. For additional details of the structure and operation of the log saw, reference may be had to the already mentioned U.S. Pat. No. 4,041,813 the same is expressly incorporated herein by this reference.

It will be appreciated, however, that the sharpening means of the invention can have equally advantageous application to forms of cutting devices other than those having the features of the illustrated embodiment. The sharpening means is generally designated 24 and is seen in greater detail in the ensuing figures.

To achieve the bevel sharpening deemed so advantageous for cutting discs, a pair of grinders or sharpening wheels or stones 25 and 25′ are provided, one for each side of the disc.

Figure 2:
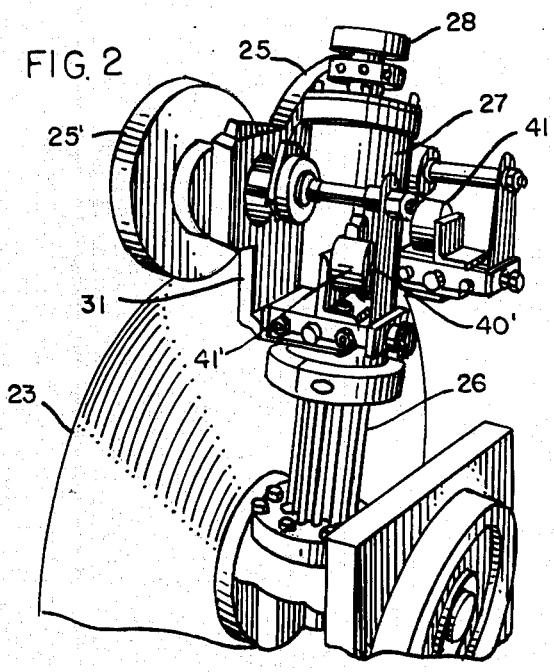
FIG. 2 is a fragmentary perspective view on enlarged scale of the sharpening means seen schematically depicted in the upper central portion of FIG. 1 and viewed from approximately the same angle as seen in FIG. 1.
Figure 3:
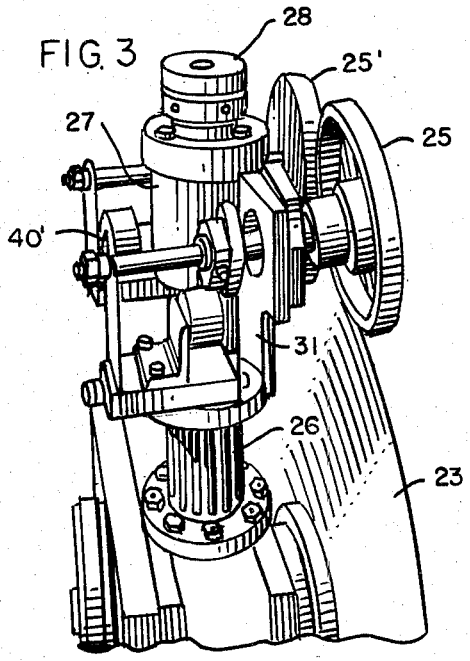
FIG. 3 is another fragmentary perspective view of the sharpening means of the invention but viewed from the side opposite that seen in FIG. 2.

Only one of the sharpening means 24 is illustrated in FIG. 1, the lower unit being omitted to show the splined shaft 26 on which the unit is mounted so as to permit generally radial movement of the unit (and hence, the stones 25 and 25′) in order to compensate for wear of the disc blade 23. The means for achieving this radial movement can be seen readily in FIGS. 2, 3 and 5 where a housing 27 is provided on the splined shaft 26 (see particularly FIG. 5) and an adjusting knob 28 provided thereon for controlling the vertical movement (as shown) of the sharpening device 24 relative to the arm 22.

Figure 4:
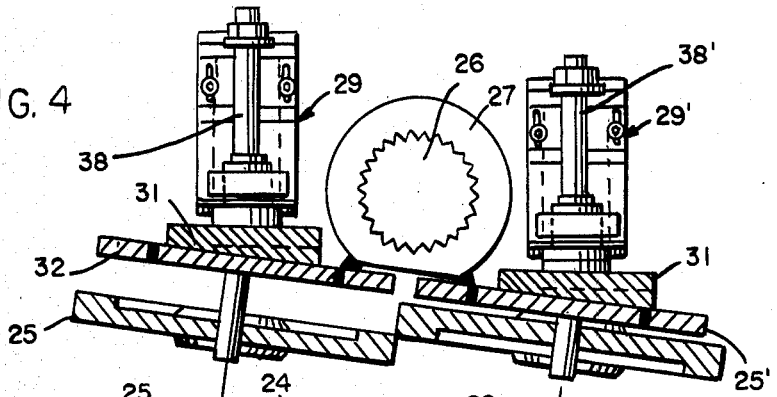
FIG. 4 is a fragmentary top plan view of the sharpening means seen in FIGS. 2–4.
Figure 5:
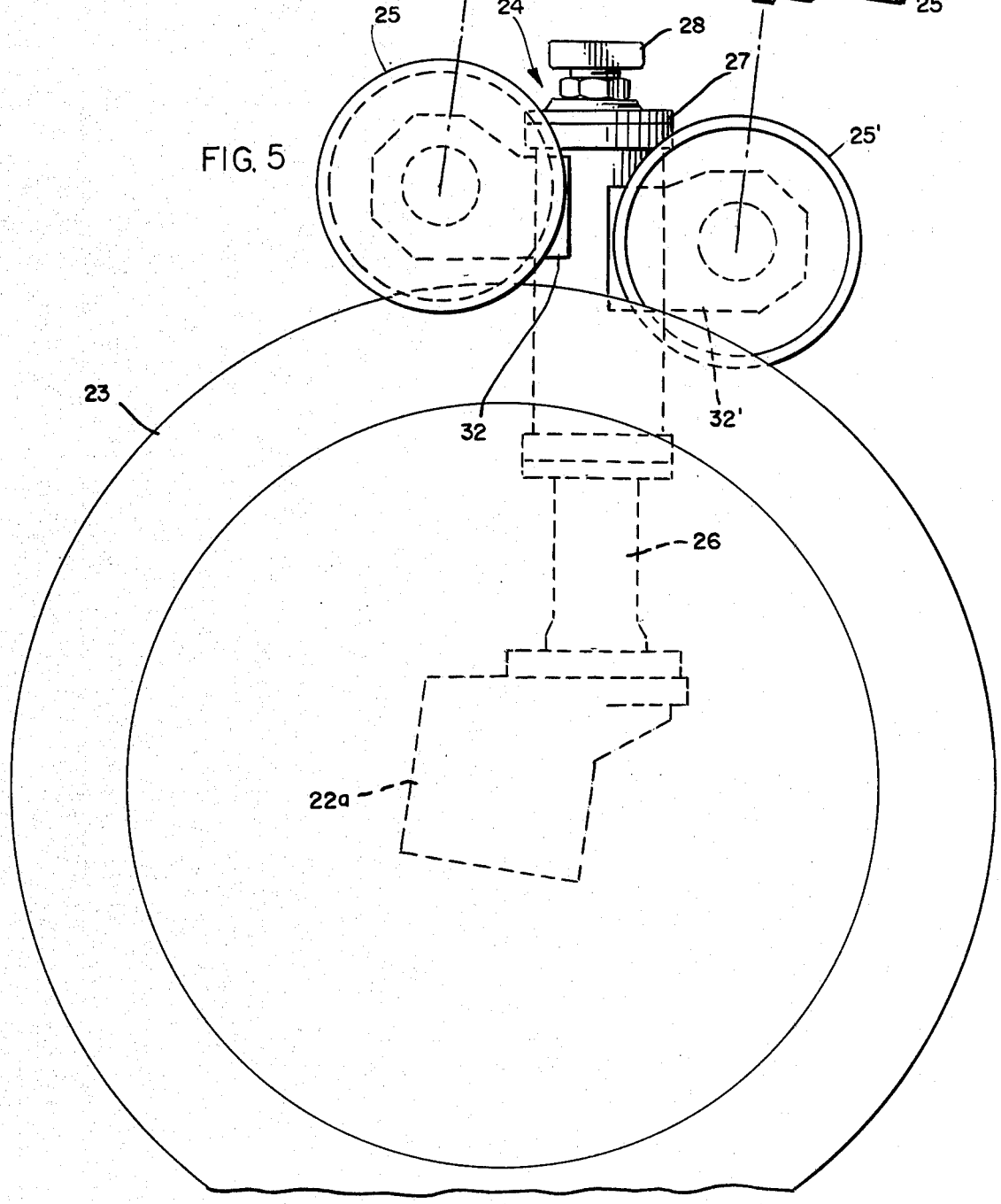
FIG. 5 is a fragmentary end elevational view of the sharpening means as installed on the frame of the log cutting apparatus of FIG. 1 and featuring a portion of the disc to be sharpened thereby.

As can be best appreciated from a consideration of FIGS. 4 and 5, each sharpening means 24 includes a pair of devices generally designated 29 and 29′ which include the grinding stones 25 and 25′, respectively. The devices are substantially identical except for the fact that one is used for sharpening the "near" side of the disc, i.e., that closer to the arm 22 while the other sharpens the "far" or "remote" side of the disc 23. Because of that, there are certain minor differences in structure, but none in function. But, because of this substantial similarity, only one of the sharpening devices will be described in detail.

Sharpening Device

Figure 6:
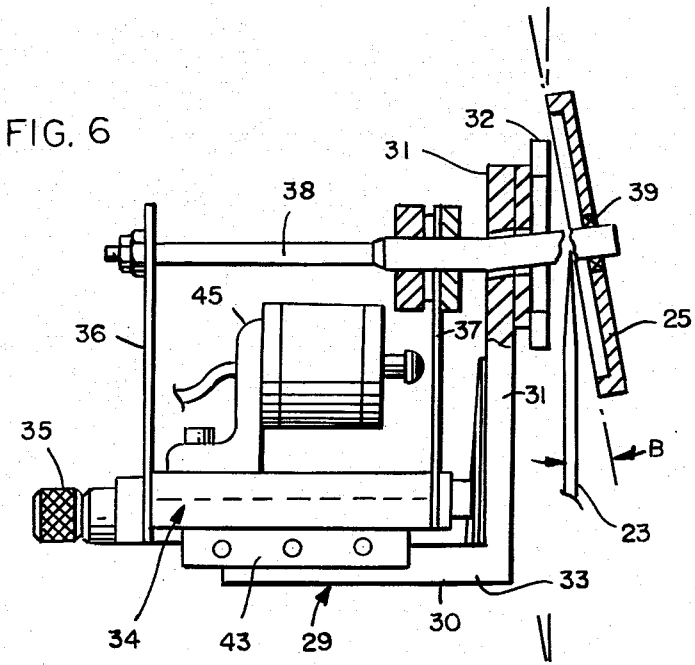
Figure 11:
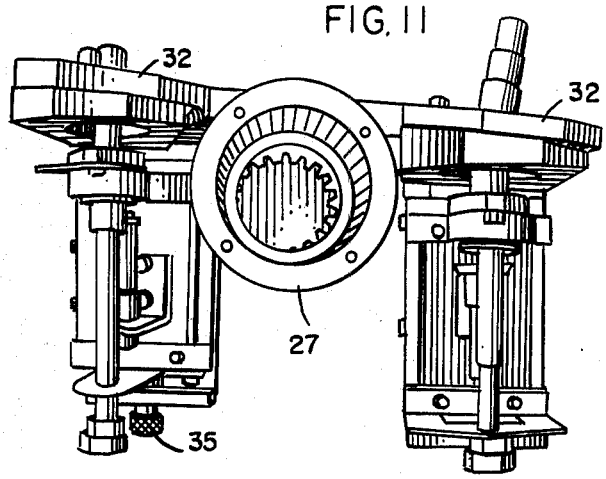
FIG. 11 is a top perspective view of the sharpening means.

Reference is now made to FIG. 6 which shows the sharpening device 29 which is associated with the sharpening stone 25 and which operates on the "far" side of the disc blade 23. It will be seen that the plane of the sharpening stone 25 is disposed at a minor angle B relative to that of the disc 23 so as to achieve the desired bevel. To support the stone, the device 29 is equipped with a bracket means 30 in the form of an L-shaped bracket. The precise shape of the bracket is not critical, being L-shaped here because the vertical or generally radially disposed leg 31 provides a convenient means for mounting of the device 29 on the arm 22. This can be appreciated from FIG. 5 where a portion of the arm is designated 22*a* and carries the splined shaft 26. Projecting from the housing 27 which is adjustably carried on the shaft 26 are arms 32 and 32′ to which the respective legs 31 and 31′ (see also FIG. 11) are secured. As can be seen in FIG. 4, the arms 32 and 32′ are welded to the housing 27.

Figure 12:
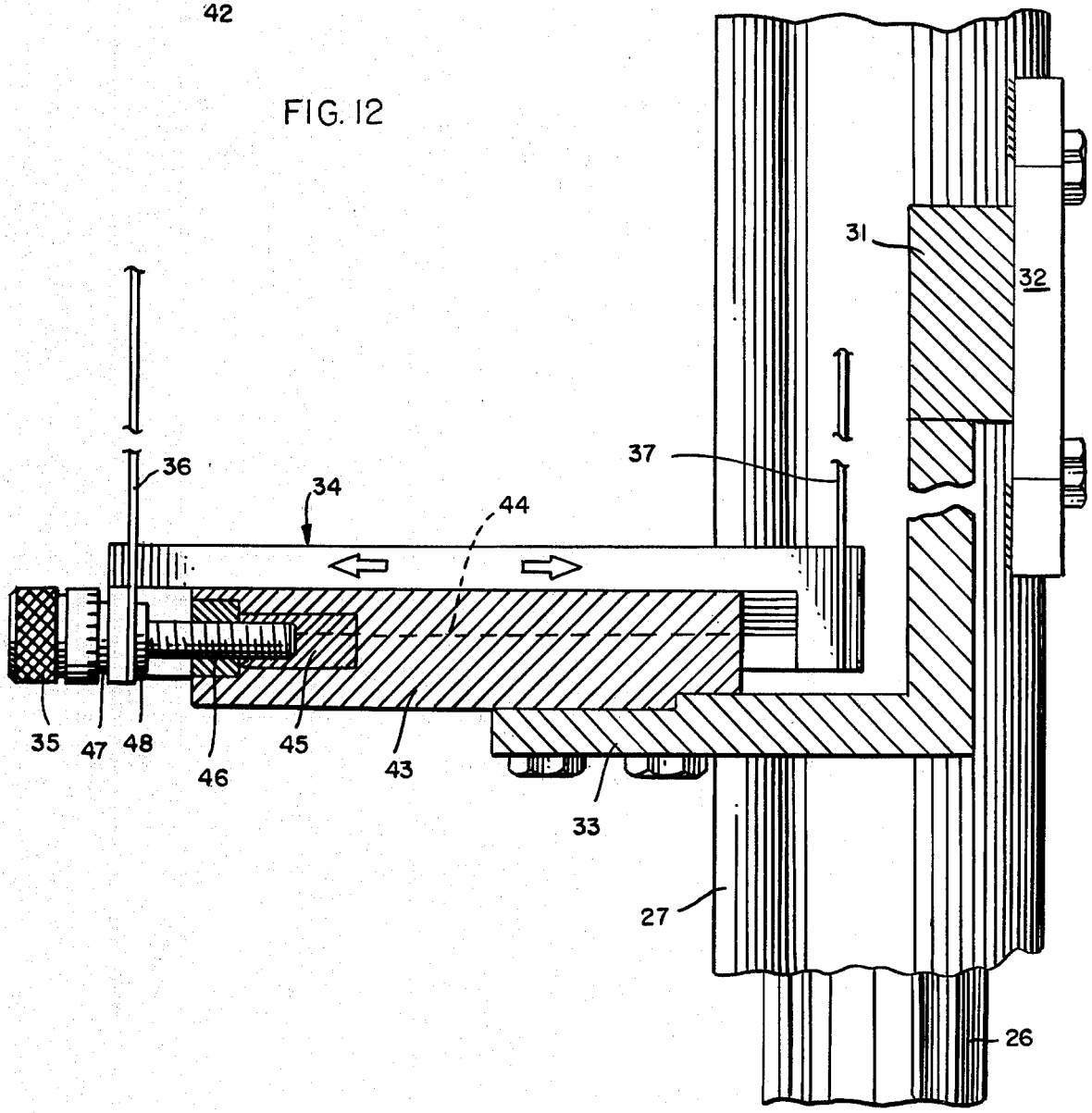
FIG. 12 is an enlarged fragmentary sectional view of the means for adjusting the sharpening stones.

Returning now to FIG. 6, the bracket 30 is equipped with a second arm 33 which is generally axially disposed relative to the disc 23. Slidably mounted on the radially disposed arm 33 is a carriage generally designated 34. By means of a threaded connection controlled by the knob 35 (see FIG. 12), the carriage 34 can be moved toward or away from the disc blade 23.

Extending upwardly, i.e., generally radially, from the carriage 34 are a pair of leaf-spring elements 36 and 37. The leaf-spring elements 36 and 37 are rigidly fixed relative to the carriage 34 and at their upper ends are clamped to a shaft 38. The fixed shaft 38 rotatably carries the rotatable sharpening stone 25 through the interposition of a bearing 39. Thus, the sharpening stone 25 is free to rotate in the plane indicated.

Figure 7:
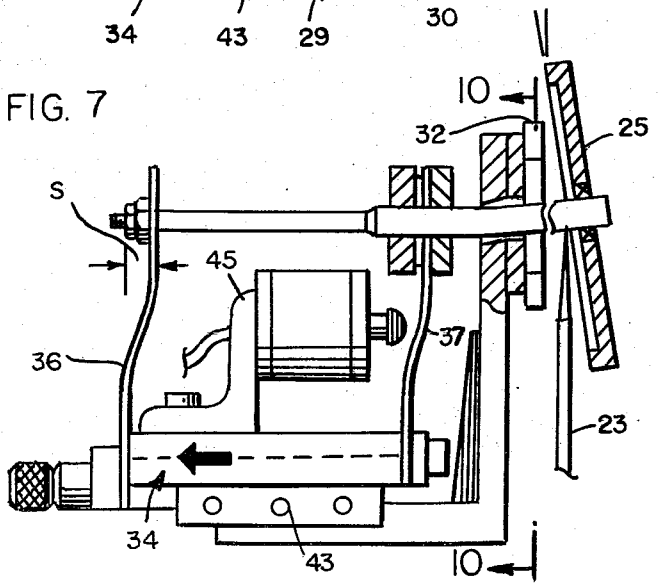

Referring now to FIG. 7, the condition of the device is depicted when the carriage 34 has been moved to the left as indicated by the arrow thereon. This causes the sharpening stone 25 to move also to the left until it engages the disc blade 23 whereupon further movement of the stone 25 is stopped. However, the carriage can be moved further so as to distort or deform the leaf-springs 36 and 37—as illustrated in exaggerated form in FIG. 7. This develops the desired pressure of the stone against the disc for proper sharpening.

Figure 8:
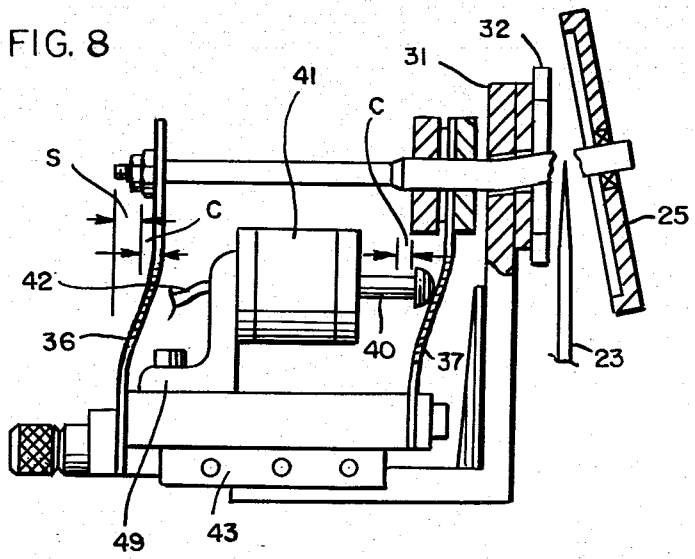
FIGS. 6–8 are fragmentary side elevational views, somewhat schematic, of the sharpening means and showing various modes of operation.

As indicated at the outset, the sharpening occurs intermittently and the non-sharpening mode is illustrated in FIG. 8. There the leaf-springs 36 and 37 are further deformed so as to move the sharpening stone 25 away from the surface of the disc 23. For example, in FIGS. 7 and 8, the amount of deformation of the leaf-springs 36 and 37 needed in order to bring the stone 25 into the sharpening mode is designated S. Thereafter, the further deformation in order to interrupt sharpening, is designated C and this is achieved by extending the rod 40 of a fluid pressure cylinder 41 into engagement with the leaf-spring 37. This can be done at any desired frequency depending upon the application of the disc, i.e., a difficult or relatively easy cutting operation.

Figure 10:
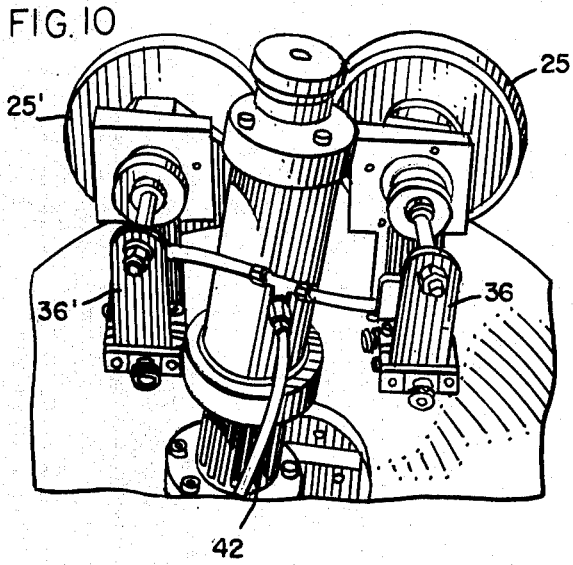
FIG. 10 is a fragmentary perspective view on enlarged scale, being essentially intermediate to the view seen in FIGS. 2 and 3.

The signal, in the form of a change in fluid pressure as illustrated, is applied through the line 42 (see FIG. 10). This goes simultaneously to the cylinder 41 associated with the unit 29 and to the cylinder 41′ associated with the device 29′ (see FIG. 2). Herein lies one difference between the two devices because the rod 40′ of the cylinder 41′ operates against the "far" leaf-spring, not the "near" leaf-spring 37' as was the case with the unit 29.

Operation

Figure 9:
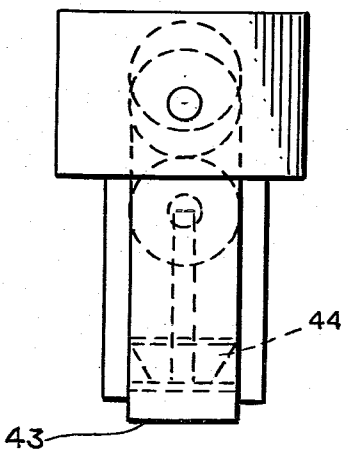
FIG. 9 is an end elevational view of the sharpening device of FIGS. 6–8.

FIGS. 6–8 show various modes of operation of the inventive grinding assembly. In FIG. 7, the L-shaped support 29 is the base structure arranged on the arm 22 so that the upstanding leg 31 is mounted in a plane parallel with the plane of the orbiting motion for the arm 22. In FIGS. 6–8 the blade therefore is not precisely shown in true perspective, but for the sake of clarity, the illustrations represent only the central part of the blade taken at a vertical cross section. In FIG. 6, a guide member 43 is fixed to the horizontal arm 33 of the L-shaped bracket 30. The member 43 provides an upstanding dovetail 44 (see FIG. 9) which is received within a corresponding rabbeted groove within the carriage 34—see FIG. 12. The dovetail portion 44 contains a bushing 45 equipped with screw threads which coact with the rotatable screw 46 terminating in the knob 35 such that the carriage 34 can be moved to the right or left relative to the arm 33 by rotation of the threaded lead screw which in turn is caused by rotation of the adjustment knob 35. As can be seen readily in FIG. 12, the carriage 34 moves with the screw 46, being journaled thereon by collars 47 and 48.

It will be noted that the working parts of each grinder stone assembly including the stones 25, stationary shaft 38, flex spring supports 36 and 37 as well as the carriage 34 and cylinder 41 all move right or left in unison with the carriage 34. In FIG. 6, the flexing blade supports, i.e., leaf springs 36 and 37 are substantially non-deflected. Knob 35 is rotated such that the entire assembly supported by the carriage 34 moves to the left until the grinding stone 25 just touches the edge of blade 23.

In FIG. 7, the knob 35 is adjusted so that the flexing springs 36, 37 are deflected equal to S. This amount of deflection in the flexible spring supports 36, 37 translates to a very light grinding pressure of stone 25 against blade 23 and represents the normal "grind" mode. It will be recognized that grinding occurs only intermittently, that is only when the blade has become dull. Under normal circumstances, the no grind mode operation shown in FIG. 8 is employed.

In FIG. 8, pneumatic pressure is applied through the inlet hose 42 (compare FIG. 10) to air cylinder 41 mounted on the angle clip 49. The clip 49 in turn is carried by the carriage 34. As a result, the rod 40 extends an additional distance C, thus further deflecting the flexing supports 36, 37 a distance totaling S plus C and results in a clearance C between the grinding stone 25 and the blade 23. For a greater portion of the total log sawing cycle, pressure will be applied to air cylinder 41 such that the grind stones 25, 25' are deactivated and not in contact with blade 23. By manual operation when needed, or predetermined time cycle, air cylinder 41 can be deactivated (to the condition of FIG. 7) so that the rod 40 withdraws, causing flex springs 36, 37 to assume the normal deflective position (only being deflected S of FIG. 7) thus applying the preset amount of light grind pressure of the grinding stone 25 against blade 23 during the active or grinding portion of the total log sawing cycle. By manual or automatic control, it should be recognized that grinding can be activated during each orbital rotation of the blade, or after a few rotations of the orbital blade, or at relatively extended periods of time simply by purging air pressure and deactivating air cylinder 41. In FIGS. 6–8, the blade grinding assembly with flexible supports relate to the grinding stone which extends beyond blade 23 and is effective on the "opposite" side. In these illustrations, that stone is mounted to the right of blade 23. Since grinding stone 25' operates on the opposite side of the blade and therefore grinds an oppositely tapered portion of the blade on that side, the same general arrangement is used but with carriage 34, air cylinder 41 and rod 40 mounted in reverse and operative upon flex spring 36 rather than 37. To apply light pressure of grind stone 25' against blade 23, support carriage 34 and the entire assembly would be moved to the right by the corresponding knob 35 with blades 36, 37 flexing oppositely from S of FIG. 7.

While in the foregoing specification, a detailed description of an embodiment of the invention has been set down for the purpose of illustration, many variations in the details hereingiven may be made by those skilled in the art without departing from the spirit and scope of the invention.

I claim:

1. Apparatus for bevel sharpening the periphery of a cutting disc comprising first and second devices equipped with grinding stones, one for each side of the disc, each device including bracket means mounted adjacent said disc and projecting generally axially of said disc and adjustably supporting a carriage, a shaft for the grinding stone of each device, resilient leaf spring means connecting said carriage with said shaft whereby adjustment of said carriage deforms said leaf spring means to adjust the pressure of said grinding stone against said disc, and means operably associated with said carriage for further deforming said leaf spring means when the same is in a disc sharpening mode to displace said stone from contact with said disc.

2. The apparatus of claim 1 in combination with an orbital saw, said saw including a frame for advancing product along a lineal path, said frame being equipped with arm means orbitally supporting said disc.

3. The apparatus of claim 2 in which each device is adjustably mounted on said arm means for movement generally radially of said disc to compensate for wear thereof.

4. The apparatus of claim 1 in which said deforming means includes a rod-equipped fluid pressure cylinder operable to contact said leaf spring means, and fluid pressure supply means to simultaneously actuate the cylinders of both devices.

5. The apparatus of claim 4 in which said devices are arranged in side-by-side relation on one side of said disc, a pair of leaf springs being fixed to each bracket means in axially spaced relation to said disc, the rod of one device being adapted to bear against the leaf spring nearer said disc and the rod of the other device being adapted to bear against the leaf spring thereof more remote from said disc.

6. The structure of claim 1 in which said carriage is dovetail mounted on said bracket means and screw means interconnecting said carriage and bracket means for controlling the position of said carriage on said bracket means.

7. Apparatus for cutting comprising a frame, means on said frame for advancing a product along a lineal path for transverse cutting thereof, an arm rotably mounted on said frame and equipped with a cutting disc for movement through an orbit intersecting said path, disc sharpening means on said arm including first and second devices each equipped with grinding stones, one for each side of the disc, each device including bracket means mounted adjacent said disc and projecting generally axially of said disc and adjustably supporting a carriage, a shaft for the grinding stone associated therewith, resilient leaf spring means connecting said carriage with said shaft whereby adjustment of said carriage deforms said leaf spring means to adjust the pressure of said grinding stone against said disc.

8. The apparatus of claim 7 in which said arm rotates in a plane skewed slightly to the perpendicular to said path, a portion of each of said bracket means being angled to compensate for said skew and to achieve the bevel associated therewith, said stones being rotatably mounted on said shafts.

9. The apparatus of claim 7 in which means are operably associated with said carriage for further deforming said leaf springs means when the same is in a disc sharpening mode to displace said stone from contact with said disc.

10. The apparatus of claim 7 in which said arm is equipped with splined shaft means extending generally radially of said disc, and means connecting said sharpening means to said splined shaft means for movement thereon to compensate for disc wear.

* * * * *